US005133681A

United States Patent [19]

Lobe

[11] Patent Number: 5,133,681

[45] Date of Patent: Jul. 28, 1992

[54] FRANGIBLE SAILBOARD FIN RETAINING MEMBER

[76] Inventor: Henry J. Lobe, P.O. Box 3374, Annapolis, Md. 21403

[21] Appl. No.: 698,127

[22] Filed: May 10, 1991

[51] Int. Cl.[5] ..... B63B 35/79

[52] U.S. Cl. ..... 441/79; 441/74; 114/39.2; 114/127

[58] Field of Search ..... 441/74, 79; 114/127, 114/140, 39.2, 162, 274

[56] References Cited

U.S. PATENT DOCUMENTS

| | | | |
|---|---|---|---|
| 1,730,844 | 10/1929 | Dupuis | 114/140 |
| 3,564,632 | 2/1971 | Bahne, Jr. | 9/310 |
| 3,846,030 | 11/1974 | Katt | 403/2 |
| 4,052,826 | 10/1977 | Chisholm | 52/98 |
| 4,398,485 | 8/1983 | Dizière | 114/132 |
| 4,528,924 | 7/1985 | Marker et al. | 114/39 |
| 4,701,144 | 10/1987 | DeWitt, III | 441/79 |
| 4,846,745 | 7/1989 | Lobe | 441/79 |
| 4,964,826 | 10/1990 | Lobe | 441/79 |

FOREIGN PATENT DOCUMENTS

| | | | |
|---|---|---|---|
| 3043496 | 6/1982 | Fed. Rep. of Germany . | |
| 3129566 | 2/1983 | Fed. Rep. of Germany . | |
| 3801747 | 8/1989 | Fed. Rep. of Germany | 441/79 |
| 2510968 | 2/1983 | France . | |
| 90/13472 | 11/1990 | World Int. Prop. O. | 441/79 |

OTHER PUBLICATIONS

Boards, No. 73, Jan./Feb. 1991, "20 Minutes with Naish."

"High Fidelity Fin System," Slalom 260/Slalom 270, Ultra Sport (UK) Ltd.

Wind Shear Products, "Breakaway FIN TABS".

*Primary Examiner*—Sherman Basinger

*Assistant Examiner*—Thomas J. Brahan

[57] ABSTRACT

A frangible sailboard fin retainer and method of releasably retaining a fin to a sailboard fin box including forming complementary openings in the fin and the fin box, inserting a bolt assembly having a bolt and a threaded female threaded member joining the fin and fin box. A portion preferably a position of the threaded member is brittle and breakable upon impact of the fin as a result of an aftward blow on the fin.

15 Claims, 2 Drawing Sheets

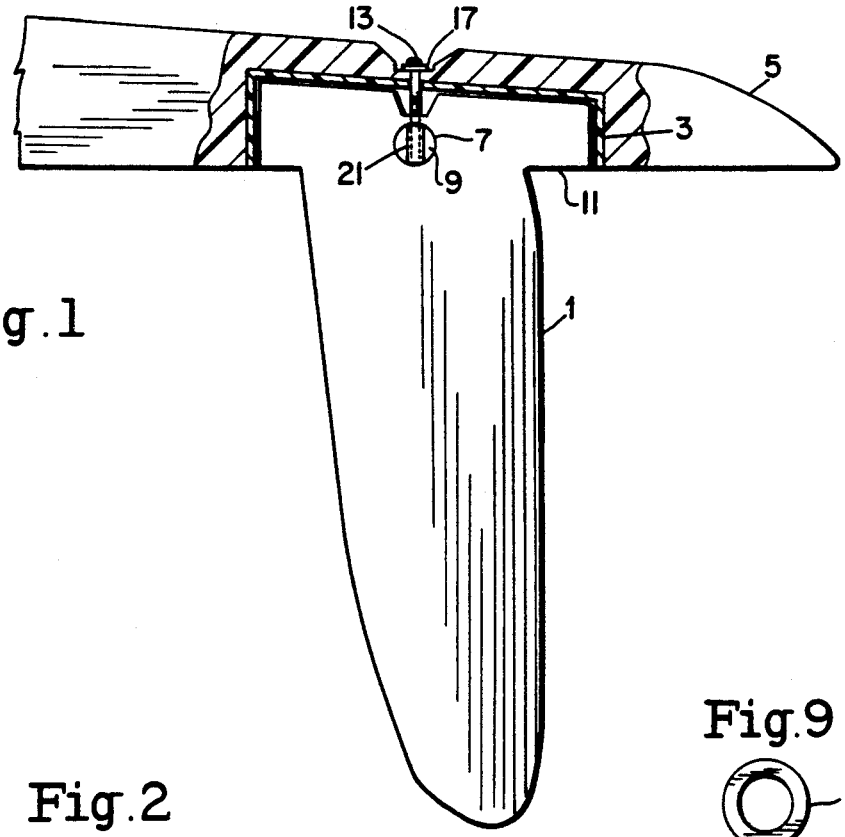
Fig.1
Fig.2
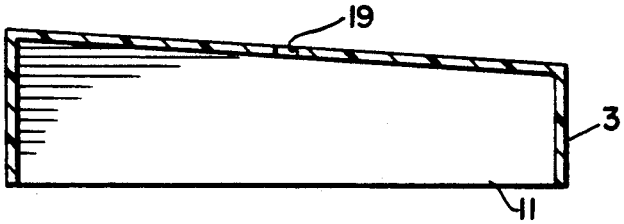
Fig.3
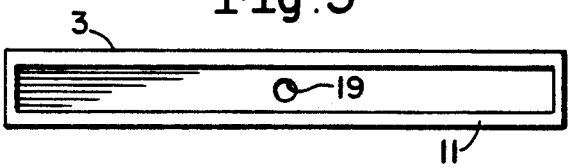
Fig.4
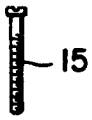
Fig.5
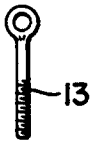
Fig.6
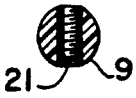
Fig.7
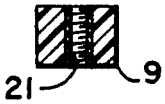
Fig.8
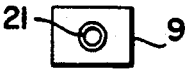
Fig.9
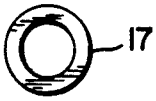
Fig.10
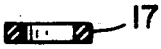
Fig.11
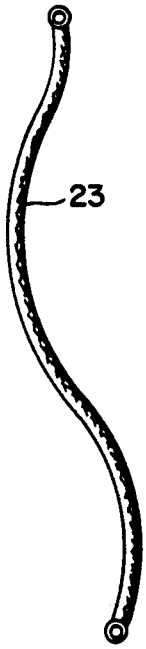

FRANGIBLE SAILBOARD FIN RETAINING MEMBER

BACKGROUND OF THE INVENTION

1. Field of the Invention

The invention relates to a method and apparatus for protecting sailboard fins, fin holders, and board structure from damage in the event that the fin strikes an underwater object.

2. Related Art

Sailboarding since its introduction in the 1970's has become an international sport of major proportions and is considered to be the fastest growing water sport in the world. Sailboards are used in conditions ranging from a slight breeze on a calm lake to gale force winds in rough ocean surf.

A sailboard usually consists of a substantially flat, elongated board, a sail system, an optional centerboard system, and a fixed fin mounted aft. Much of the design of the sailboard has been borrowed directly from surfboards, including the fixed fin.

The fixed fin is fastened to a fin holder, the fin holder being permanently molded or fastened into the sailboard. This combination of fin and fin holder allows the fin to easily be installed and removed.

Because of the versatility and shallow drafts of sailboards, these craft are often sailed in areas where the aft mounted fin will come into contact with an underwater obstruction, such as rocks, reefs, underwater debris, or the bottom of the sailing area. Damage due to the fin striking an underwater object may result in the following:

1. Breaking of the fin
2. Breaking of the fin holder
2. Delamination of the fin holder from the board structure
4. Damage to the sailboard
5. Any combination of the above Replacement or repair of the damage described above is in most cases very costly. It is therefore highly desirable to fasten the fin to the fin holder in such a manner as to protect the fin and more expensive fin fastening components from damaging overloads.

U.S. Pat. No. 4,398,485 by Bernard Diziere for DEVICE FOR DETACHABLY SECURING A CENTERBOARD TO A SAILBOARD OR THE LIKE has a similar object as the present invention, to protect the fin and sailboard from damage when the fin hits something. Diziere illustrates the need for this type of protection. Himmer, Diziere completely replaces the standard fin holder with an incompatible fin non-industry fin holder.

Reference is also made to my previous U.S. Pat. Nos. 4,846,795 and 4,964,826, as well as the art cited therein, wherein members which fail under impact are disclosed.

A nylon screw has been used between the outside of the board assembly and the fin. The purported purpose of the screw has been to fail under impact. However, the basic problem with this approach is that the nylon screw is too weak to function during normal use because a nylon or similar type screw cannot stand-up during normal tightening of the fin and/or under steady state loads incurred in normal sailing conditions.

References should be made to German Offenlegungsschrift DE 3043496 which discloses a tether in the form of flexible or elastic cord.

The generic term for this type of fin holder is: "Through the Deck Fin Box." This term is derived from the fact that the fin fastening screw is inserted through the deck of the board.

The through the deck fin box was developed to provide the fin with increased lateral support, as compared to adjustable fin boxes. The increased lateral fin support is due to the increased depth of the holder. Another advantage of this type of fin holder is the decreased hydrodynamic drag due to the fin completely filling the open cavity of the fin holder when installed as well as the lack of a fastening screw at the open end of the holder. A distinct disadvantage of this type of fin holder assembly is the lack of adjustability.

SUMMARY OF THE INVENTION

The present invention provides a method of securely mounting a fin to a through the deck fin box while also providing a means of stress relief to the fin, fin holder, and board structure in the event that the fin experiences physical impact from striking an underwater obstruction. The invention can be used on any sailboard which has the conventional through the deck fin box described below.

The fin holder used with the invention consists of a rectangular shaped channel which opens flush with the bottom surface of the sailboard. The bottom of the fin box can be open or closed. ("Top and bottom" refer here to the board when upside down for storage or to be worked on. When the board is in use the closed bottom of the channel is above its open top.) The depth of the box is typically tapered so that it is deeper toward the front of the board and shallower toward the rear of the board. The taper provides increased lateral support for the fin as opposed to a constant depth fin holder the maximum depth of which would be restricted to the minimum thickness of the tail of the board where the fin holder is installed.

The taper of the fin holder also facilitates release of the fin should the fin be exposed to forward impact which damages its fastening components.

A fin having a longitudinal base member fits into the open channel of the fin holder. The base of the fin is typically of substantially the same dimensions as the fin holder, so that the entire open end of the fin holder is filled by the base of the fin.

The sides of the fin holder can be either parallel, in which case the fin is clamped to the bottom of the holder, or converging in which case the sides of the fin are wedged against the sides of the fin holder. The fin base member is supported with a snug fit by the four inner sides of the fin holder against lateral forces (the principal forces on the fin), as well as front and rear loads. The fin base member may also derive additional support from contact with the closed bottom of the fin holder.

The securing means described below serve to secure the fin in the fin holder.

The center of the base of the fin houses a vertical threaded member such that the threads align themselves with a vertically installed fastening bolt. The fin is secured against being pulled out of the fin holder by a fastening screw inserted through the top of the deck of the sailboard, through the bottom of the fin holder and into the threaded portion of the fin. The head of the fastening screw is supported either by the top surface of the deck of the board, or by the outside of the bottom of the fin holder, depending upon the fin holder and construction technique used.

A washer is usually placed under the head of the fastening screw to protect the fin holder or board structure from damage from the head of the screw. The fin is drawn into the fin holder by tightening the fastening screw against the outside bottom of the fin holder or deck surface of the sailboard.

The threaded member installed in the fin is preferably made of materials which will suffer catastrophic breakage in the event that such components experience sudden severe loads, as would be the case in the event that the fin of the sailboard strikes an underwater obstruction. Upon the breaking of the threaded member, the fin will become unattached from the fastening screw, thereby causing the release of the fin from the fin holder.

In another embodiment, the breaking member is the washer under the head of the fastening screw. The washer is made of materials which will also suffer catastrophic breakage in the event that these components experience sudden severe loads, as would be the case in the event that the fin of the sailboard strikes an underwater obstruction. Upon breaking of the washer the fastening bolt will become detached from the sailboard and fin holder by virtue of the fact that the diameter of the head of the fastening screw is smaller than the diameter of the holes through the deck of the sailboard and the fin holder, thus causing the fin and fastening bolt to release from the fin holder assembly.

The fin may be retained by the use of a tether attached to the fin and to the sailboard. The tether is attached to the board structure when using a failing threaded member by the connection of the tether to the fastening bolt upon installation of the fin. The retention of an insert on the bottom of the fastening bolt after failure of the threaded member keeps the tether from sliding off of the end the bolt as well as keeping the fastening bolt attached to the sailboard. The tether is stored in unused space within the fin holder during non-failure mode fin attachment and use. The opposite end of the tether is attached to the fin in this failure mode by connection to some portion of the fin base.

The tether is attached to the fin when using a failing washer by connection to an eyelet on the top of the fastening bolt as the fin and fastening bolt remain attached after separating from the fin holder and sailboard. The opposite end of the tether is attached to the sailboard in this failure mode by connection to some portion of the deck surface of the sailboard.

The tether is stored on the deck of the sailboard during non- failure fin attachment and use.

The disclosed fin holder differs from the adjustable fin holders described in earlier references in that:

1. The rectangular smooth walled cavity does not incorporate parallel longitudinal grooves.

2. The length of the cavity is typically the same as the base of the fin, making the fin non-adjustable.

3. The fin is secured via a threaded screw member which is inserted through the deck of the sailboard into the fin base.

This fastening method secures the fin to the sailboard by drawing the base member of the fin securely into the holder assembly.

The release mechanism will greatly reduce the risk of fin breakage, fin holder breakage, delamination of the fin holder from the board structure, and damage to the board. Only a small part will have been broken, one for which replacements are easily kept ready and installed.

SUMMARY OF THE INVENTION

The present invention provides a method of securely mounting a fin to a through the deck fin box while also providing a means of stress relief to the fin, fin holder, and board structure in the event that the fin experiences physical impact from striking an underwater obstruction. The invention can be used on any sailboard which has the conventional through the deck fin box described below.

The fin holder used with the invention consists of a rectangular shaped channel which opens flush with the bottom surface of the sailboard. The bottom of the fin box can be open or closed. ("Top and bottom" refer here to the board when upside down for storage or to be worked on. When the board is in use the closed bottom of the channel is above its open top.) The depth of the box is typically tapered so that it is deeper toward the front of the board and shallower toward the rear of the board. The taper provides increased lateral support for the fin as opposed to a constant depth fin holder the maximum depth of which would be restricted to the minimum thickness of the tail of the board where the fin holder is installed.

The taper of the fin holder also facilitates release of the fin should the fin be exposed to forward impact which damages its fastening components.

A fin having a longitudinal base member fits into the open channel of the fin holder. The base of the fin is typically of substantially the same dimensions as the fin holder, so that the entire open end of the fin holder is filled by the base of the fin.

The sides of the fin holder can be either parallel, in which case the fin is clamped to the bottom of the holder, or converging in which case the sides of the fin are wedged against the sides of the fin holder. The fin base member is supported with a snug fit by the four inner sides of the fin holder against lateral forces (the principal forces on the fin), as well as front and rear loads. The fin base member may also derive additional support from contact with the closed bottom of the fin holder.

The securing means described below serve to secure the fin in the fin holder.

The center of the base of the fin houses a vertical threaded member such that the threads align themselves with a vertically installed fastening bolt. The fin is secured against being pulled out of the fin holder by a fastening screw inserted through the top of the deck of the sailboard, through the bottom of the fin holder and into the threaded portion of the fin. The head of the fastening screw is supported either by the top surface of the deck of the board, or by the outside of the bottom of the fin holder, depending upon the fin holder and construction technique used.

A washer is usually placed under the head of the fastening screw to protect the fin holder or board structure from damage from the head of the screw. The fin is drawn into the fin holder by tightening the fastening screw against the outside bottom of the fin holder or deck surface of the sailboard.

The threaded member installed in the fin is preferably made of materials which will suffer catastrophic breakage in the event that such components experience sudden severe loads, as would be the case in the event that the fin of the sailboard strikes an underwater obstruction. Upon the breaking of the threaded member, the fin will become unattached from the fastening screw, thereby causing the release of the fin from the fin holder.

In another embodiment, the breaking member is the washer under the head of the fastening screw. The washer is made of materials which will also suffer catastrophic breakage in the event that these components experience sudden severe loads, as would be the case in the event that the fin of the sailboard strikes an underwater obstruction. Upon breaking of the washer the fastening bolt will become detached from the sailboard and fin holder by virtue of the fact that the diameter of the head of the fastening screw is smaller than the diameter of the holes through the deck of the sailboard and the fin holder, thus causing the fin and fastening bolt to release from the fin holder assembly.

The fin may be retained by the use of a tether attached to the fin and to the sailboard. The tether is attached to the board structure when using a failing threaded member by the connection of the tether to the fastening bolt upon installation of the fin. The retention of an insert on the bottom of the fastening bolt after failure of the threaded member keeps the tether from sliding off of the end the bolt as well as keeping the fastening bolt attached to the sailboard. The tether is stored in unused space within the fin holder during non-failure mode fin attachment and use. The opposite end of the tether is attached to the fin in this failure mode by connection to some portion of the fin base.

The tether is attached to the fin when using a failing washer by connection to an eyelet on the top of the fastening bolt as the fin and fastening remain attached after separating from the fin holder and sailboard. The opposite end of the tether is attached to the sailboard in this failure mode by connection to some portion of the deck surface of the sailboard.

The tether is stored on the deck of the sailboard during non- failure fin attachment and use.

The disclosed fin holder differs from the adjustable fin holders described in earlier references in that:

1. The rectangular smooth walled cavity does not incorporate parallel longitudinal grooves.

2. The length of the cavity is typically the same as the base of the fin, making the fin non-adjustable.

3. The fin is secured via a threaded screw member which is inserted through the deck of the sailboard into the fin base.

This fastening method secures the fin to the sailboard by drawing the base member of the fin securely into the holder assembly.

The release mechanism will greatly reduce the risk of fin breakage, fin holder breakage, delamination of the fin holder from the board structure, and damage to the board. Only a small part will have been broken, one for which replacements are easily kept ready and installed.

BRIEF DESCRIPTION OF THE DRAWING

The invention will be better appreciated from the following description and the accompanying drawings, wherein:

FIG. 1 is a side elevational view of the fin holder in a sailboard with the fin inserted and secured;

FIG. 2 is a side elevational view of the fin holder assembly;

FIG. 3 is a top plan view of the fin holder assembly of FIG. 2;

FIG. 4 illustrates a first embodiment of the bolt used for fastening the fin to the fin box;

FIG. 5 illustrates a second embodiment of the bolt with an eyelet used for fastening the fin to the fin box;

FIGS. 6, 7, and 8 are side, plan, and top views, respectively, of a breakable threaded member of the fin;

FIGS. 9 and 10 are side and plan views, respectively of a breakable washer.

FIG. 11 is a plan view of a tether used to retain the fin after release upon impact;

DETAILED DESCRIPTION OF THE PREFERRED EMBODIMENTS

Referring to FIG. 1 a fin 1 is shown inserted into a through the deck fin box 3, which in turn is fitted to a sailboard 5, of typical configuration.

Figure 12:
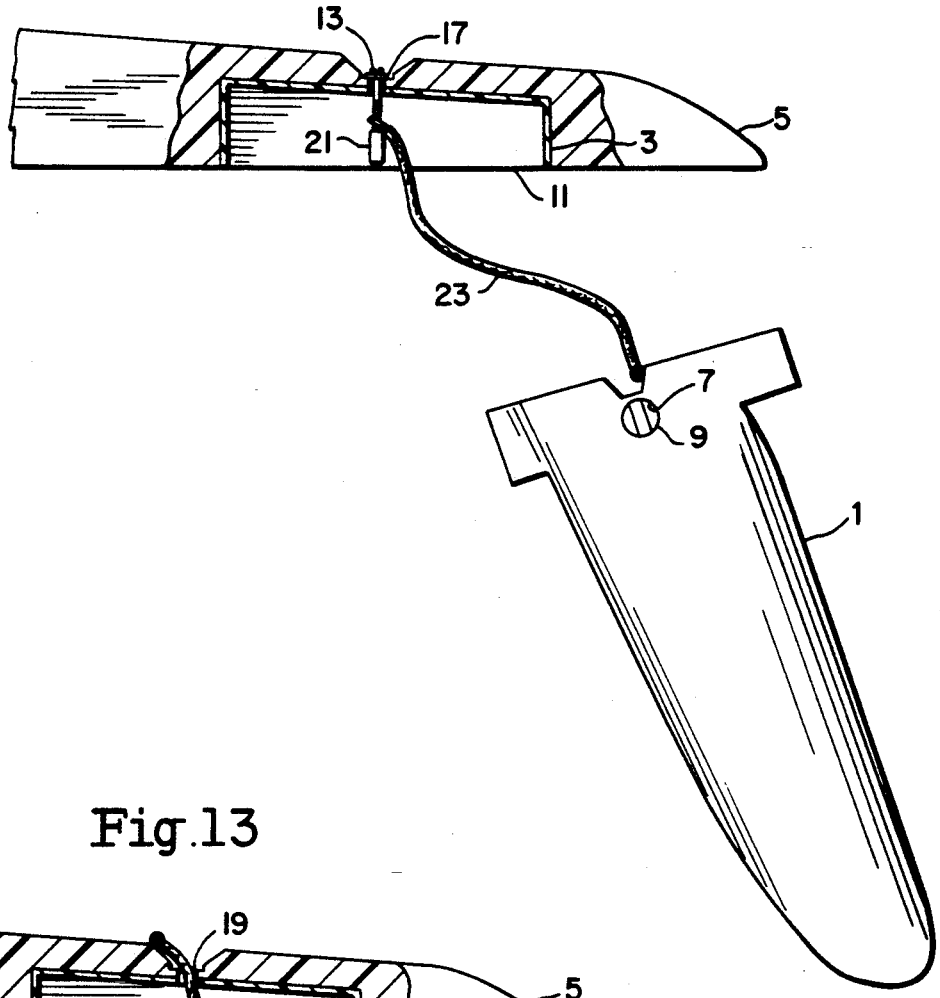
FIG. 12 is a side view of the fin holder in the sailboard according to the first embodiment with the fin released via a failing threaded member and retained by a tether, as would occur during fin impact with an underwater obstruction.
Figure 13:
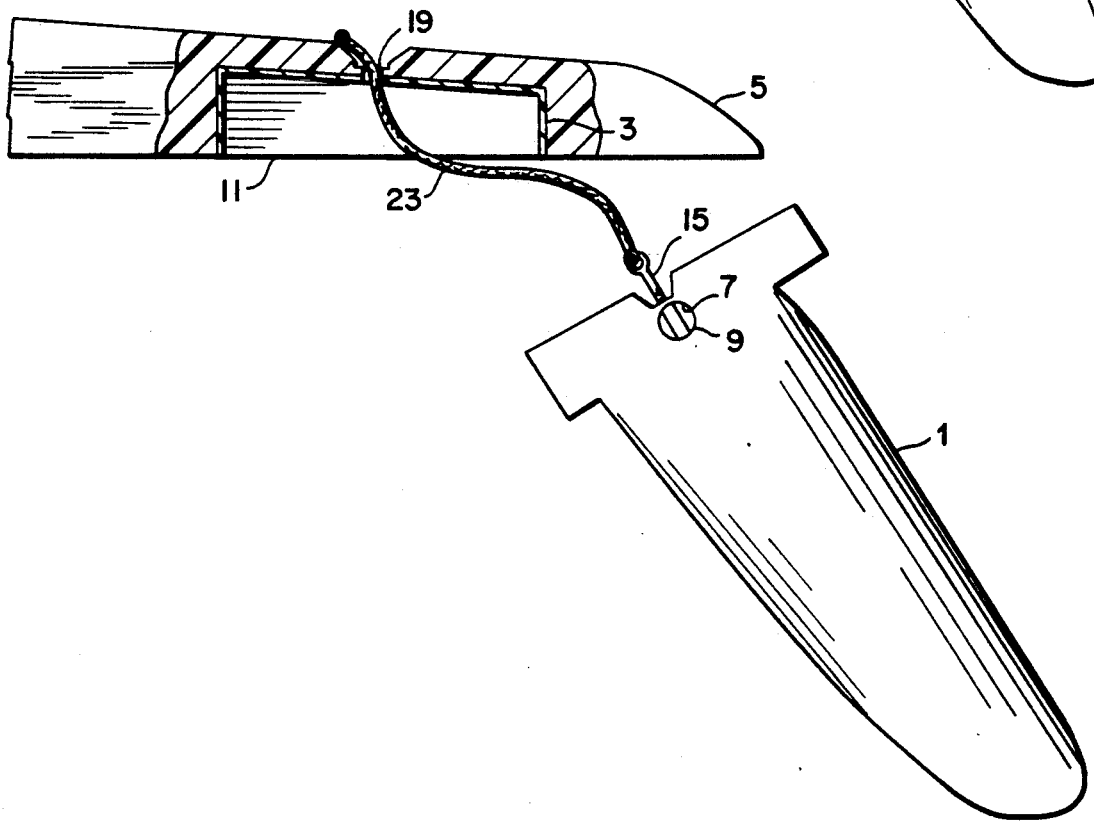
FIG. 13 is a side view of the fin holder in a sailboard according to the second embodiment with the fin released via a failing washer and retained by a tether, as would occur during fin impact with an underwater obstruction.

Referring to FIGS. 12 and 13 the fin 1 is shown released from through the deck fin box 3.

The fin 1 in FIGS. 1, 12, 13 has a smooth sided, tapered base tapered from front to rear. The center of the base has a hole 7 perpendicular therethrough. Hole 7 serves to retain a cylindrical female threaded member 9 seen in various forms in FIGS. 1, 6, 7, 8, 12, 13.

The fin box 3 has four smooth walled sides tapered from front to rear, and an open top 11 seen in FIGS. 1, 2, 3.

A bolt 13 seen in FIGS. 1, 4, 12, and a bolt 15 seen in FIGS. 5, 13 when passed through a washer 17 seen in FIGS. 9, 10, 12 and a vertical hole 19 of the fin holder 5 engages threaded member 9 in the base of the fin 1. Bolts 13 and 15 when screwed into threaded member 9 and tightened, pulls the base member of fin 1 up against the inside smoothed walled surfaces of fin box 3, thus holding fin 1 to fin box 3 securely and rigidly.

Threaded member 9 is the weakest part of the fin holding system, and it is preferably brittle as well, so that when overloaded by impact of fin 1 with an underwater obstruction, it will fail suddenly and completely.

The weakest member could also be the washer 17. Washer 17 would be made of brittle material so that it will break when overloaded by impact of fin 1 with an underwater obstruction. Either threaded member 9 or washer 17 can be replaced easily and at small cost both in money and time.

The preferred embodiment of threaded member 9 is shown in FIGS. 6, 7, 8, 12, the construction of Which consists of a cylindrical hard plastic housing and a threaded metal (e.g., brass) insert 21. A cylindrical housing is used to provide a shape which is easy to install in the base members of fins used in through the deck fin box assemblies. Insert 21 can be installed in cylinder member 9 so that materials which are tapped for bolts 13 and 15 which form threads too weak to sustain normal tightening and use. The failure mode of the preferred embodiment is then the separation of insert 21 from cylinder member 9. Another advantage of the use of insert 21 with cylinder member 9 is that the combination of insert 21 and bolts 13 and 15 retain a tether 23 and fin 1 as described below.

Tether 23 seen in FIGS. 11, 12, 13 can be employed with the described fin release systems to maintain the fin attached to the board structure after its release.

Referring to FIG. 12, tether 23 is attached to fin 1 and fastening bolts 13 and 15 when using a failing threaded member 9 with insert 21. In addition to the preferred embodiment discussed above, the insert 21 can separate from the cylindrical member 9 by simply pulling insert 21 from the cylindrical member 9 on impact as discussed in my prior U.S. Pat. No. 4,964,826 which is incorporated by reference. Insert 21 keeps tether 23 from slipping off the end of bolts 13 and 15, thereby retaining tether 23 and fin 1 to sailboard 5.

Referring to FIG. 13, tether 23 is attached to bolt 15 and sailboard 5 when using a failing washer 17, thereby retaining tether 23 and fin 1 with its still connected fastening bolt 15 to sailboard 5.

The breaking of threaded member 9 or washer 17 allows fin 1 to release from fin holder 3, while fin member 1 remains connected to sailboard 5 by tether 23. The release of the fin from the fin holder as just described will greatly reduce the chance of damage to the fin, fin holder, and sailboard, in the event that the fin suffers physical impact from the striking of an underwater obstruction.

It should be noted that the above described invention is the opposite of present practice, wherein threaded member 21 and washer 17 are stainless steel and appear to be, judging by the results of repeated accidents, the strongest and most tenacious parts of the fin holding system. As a rule, either bolts 13 and 15 break through the surface of sailboard 5 or fin holder 3 is partially or fully broken away from and or delaminated from the board structure. That is, the most expensive parts fail, not the cheapest.

While specific embodiments of the invention have been described and illustrated, it will be clear that variations in the details of the embodiments specifically illustrated and described may be made without departing from the true spirit and scope of the invention as defined in the appended claims.

What is claimed is:

1. A frangible sailboard fin retainer comprising:

a. a fin, a sailboard having an upper surface and a deck fin box in the sailboard, complementary openings in the fin and the fin box which communicate with the upper surface of the sailboard;

b. a female threaded member located in the fin cooperating with the openings;

c. a bolt extending through the openings in the fin box and into the fin and engaging the threaded member in the fin forming a bolt assembly;

d. wherein at least a portion of the threaded member is brittle and thus all parts of the fin and fin box are somewhat stronger than the assembly, sustaining ordinary loads, but wherein overloads resulting from an aftward blow to the fin will break at least a portion of the assembly and leave the fin and sailboard undamaged and permit release of the fin from the fin box.

2. The retainer of claim 1 including a threaded insert in the threaded member.

3. The retainer of claim 2 wherein the member comprises a threaded metal insert in a hard plastic housing.

4. The retainer of claim 1 wherein the bolt assembly includes a washer which is brittle.

5. The retainer of claim 1 including a tether joining the fin to the fin box.

6. The retainer of claim 5 wherein the tether is connected through an opening in the fin box.

7. The retainer of claim 5 wherein the tether is attached to the bolt.

8. The retainer of claim 1 wherein the female threaded member is cylindrical.

9. A method of releasably retaining a fin to a sailboard fin box comprising:

a. forming complementary openings in the fin and the fin box;

b. inserting a female threaded member in the fin;

c. inserting the fin in the fin box;

d. connecting the fin to the fin box by inserting a bolt from the upper surface of the sailboard through the openings into the female threaded member forming a bolt assembly wherein at least a position of the bolt assembly is separable from the remainder of the assembly;

e. separating one portion of the bolt assembly from another portion upon impact of the fin as a result of an aftward blow on the fin.

10. The method of claim 9 wherein the separation is accomplished by forming at least a portion of the bolt assembly more brittle than the remainder of the assembly and breaking the brittle portion.

11. The method of claim 9 wherein the separable portion separates from the threaded member which remains in the fin.

12. The method of claim 9 including forming the threaded member cylindrical and inserting a threaded insert therein, screwing the bolt into the insert; and upon impact the cylindrical member remains in the fin.

13. The method of claim 12 wherein the insert separates from the cylindrical member.

14. The method of claim 9 including placing a washer in the assembly and wherein the fin and the remainder of the assembly separate from the fin box upon impact.

15. The method of claim 9, including inserting a threaded insert in the threaded member, screwing the bolt into the insert; and upon impact the insert separates from the fin.

* * * * *